US010837234B2

(12) United States Patent
Marshall et al.

(10) Patent No.: US 10,837,234 B2
(45) Date of Patent: Nov. 17, 2020

(54) UNIDIRECTIONALLY EXTENDABLE CUTTING ELEMENT STEERING

(71) Applicant: Novatek IP, LLC, Provo, UT (US)

(72) Inventors: Jonathan D. Marshall, Mapleton, UT (US); Geoffrey Charles Downton, Stroud (GB); Scott R. Woolston, Spanish Fork, UT (US); David R. Hall, Provo, UT (US)

(73) Assignee: NOVATEK IP, LLC, Provo, UT (US)

( * ) Notice: Subject to any disclaimer, the term of this patent is extended or adjusted under 35 U.S.C. 154(b) by 22 days.

(21) Appl. No.: 16/216,966

(22) Filed: Dec. 11, 2018

(65) Prior Publication Data

US 2019/0292852 A1 Sep. 26, 2019

Related U.S. Application Data

(63) Continuation-in-part of application No. 15/935,316, filed on Mar. 26, 2018, now Pat. No. 10,633,923.

(51) Int. Cl.

| | |
|---|---|
| ***E21B 10/32*** | (2006.01) |
| ***E21B 7/06*** | (2006.01) |
| ***E21B 7/28*** | (2006.01) |
| ***E21B 17/10*** | (2006.01) |

(52) U.S. Cl.
CPC ..... *E21B 7/06* (2013.01); *E21B 7/28* (2013.01); *E21B 10/322* (2013.01); *E21B 17/1014* (2013.01)

(58) Field of Classification Search
CPC ..... E21B 17/1014; E21B 10/322
See application file for complete search history.

(56) References Cited

U.S. PATENT DOCUMENTS

| | | | | |
|---|---|---|---|---|
| 2,886,293 | A | 5/1959 | Carr | |
| 4,690,229 | A * | 9/1987 | Raney | E21B 10/43 175/325.4 |
| 5,213,168 | A | 5/1993 | Warren et al. | |
| 7,409,901 | B2 | 8/2008 | Lucas et al. | |
| 7,703,559 | B2 | 4/2010 | Shen et al. | |
| 7,971,662 | B2 | 7/2011 | Beuershausen | |
| 8,087,479 | B2 | 1/2012 | Kulkarni et al. | |
| 8,141,657 | B2 | 3/2012 | Hutton | |
| 8,476,368 | B2 | 7/2013 | Klipp et al. | |
| 8,590,638 | B2 | 11/2013 | Downton | |
| 8,727,036 | B2 | 5/2014 | Johnson et al. | |
| 8,746,368 | B2 | 6/2014 | Johnson et al. | |
| 8,757,294 | B2 | 6/2014 | Johnson et al. | |
| 8,763,726 | B2 | 7/2014 | Johnson et al. | |

(Continued)

*Primary Examiner* — Giovanna Wright

(57) ABSTRACT

A drilling apparatus may alter a direction of travel of a drill bit as it forms a borehole in the earth by furnishing the borehole with a cross-sectional shape that urges the drill bit in a radial direction. Such a cross-sectional shape may comprise two circular arcs, one larger than the apparatus and one smaller. The apparatus may be urged away from the smaller circular arc and into the open space provided by the larger circular arc.

Such an apparatus may comprise an axial body and a cutting element extendable in a single radial direction from an exterior of the axial body. Extension of the cutting element may allow it to engage and degrade an inner wall of the borehole. An abrasion-resistant gauge pad protruding from the exterior of the body may ride against the borehole wall and urge the body radially.

18 Claims, 10 Drawing Sheets

(56) References Cited

U.S. PATENT DOCUMENTS

| | | | | |
|---|---|---|---|---|
| 9,080,399 | B2 | 7/2015 | Oesterberg | |
| 9,085,941 | B2 | 7/2015 | Hall et al. | |
| 9,255,450 | B2 | 2/2016 | Jain et al. | |
| 9,279,293 | B2 | 3/2016 | Izbinski | |
| 9,708,859 | B2 | 7/2017 | Jain et al. | |
| 9,970,239 | B2 | 5/2018 | Oesterberg | |
| 10,119,338 | B2 | 11/2018 | Thomas et al. | |
| 2004/0222022 | A1* | 11/2004 | Nevlud | E21B 10/322 175/57 |
| 2007/0163808 | A1* | 7/2007 | Campbell | E21B 10/322 175/57 |
| 2009/0032306 | A1 | 2/2009 | Addis et al. | |
| 2009/0044980 | A1* | 2/2009 | Sheppard | E21B 7/06 175/24 |
| 2009/0057018 | A1 | 3/2009 | Farley | |
| 2010/0032207 | A1 | 2/2010 | Potter et al. | |
| 2011/0005836 | A1* | 1/2011 | Radford | E21B 10/322 175/57 |
| 2012/0168229 | A1* | 7/2012 | Lee | E21B 10/322 175/265 |
| 2013/0248252 | A1 | 9/2013 | Oesterberg et al. | |
| 2016/0053551 | A1 | 2/2016 | Jain et al. | |
| 2017/0175455 | A1 | 6/2017 | Jain et al. | |
| 2017/0218707 | A1* | 8/2017 | Hird | E21B 10/567 |
| 2017/0254150 | A1 | 9/2017 | Stockey et al. | |
| 2017/0335631 | A1* | 11/2017 | Eddison | E21B 28/00 |
| 2018/0258705 | A1 | 9/2018 | Oesterberg | |

* cited by examiner

UNIDIRECTIONALLY EXTENDABLE CUTTING ELEMENT STEERING

CROSS REFERENCE TO RELATED APPLICATIONS

This patent is a continuation-in-part of U.S. patent application Ser. No. 15/935,316 entitled "Slidable Rod Downhole Steering" and filed Mar. 26, 2018 which is incorporated herein by reference for all that it contains.

BACKGROUND

When exploring for or extracting subterranean resources, such as oil, gas, or geothermal energy, and in similar endeavors, it is common to form boreholes in the earth. Such boreholes may be formed by engaging the earth with a rotating drill bit capable of degrading tough earthen materials. As rotation continues the borehole may elongate and the drill bit may be fed into it on the end of a drill string.

At times it may be desirable to alter a direction of travel of the drill bit as it is forming a borehole. This may be to steer toward valuable resources or away from obstacles. A variety of techniques have been developed to accomplish such steering. Many known steering techniques require pushing against an interior wall of a borehole. This pushing often requires great amounts of energy to be expended downhole. Further, the amount of energy required may increase as a desired radius of curvature of the borehole decreases. Thus, a means for forming a curving borehole, and especially a curving borehole comprising a small radius of curvature, while expending less energy downhole may prove valuable.

BRIEF DESCRIPTION

An apparatus capable of altering a direction of travel of a drill bit as it forms a borehole in the earth may furnish the borehole with a cross-sectional shape that urges the drill bit in a radial direction. Significant energy may be saved in this manner as the borehole does the urging, rather than the apparatus. Such a borehole shape may have a cross section comprising two circular arcs, one comprising a larger radius than that of the apparatus and one comprising a smaller radius. The apparatus may be urged away from the smaller circular arc and into the open space provided by the larger circular arc.

Such an apparatus may comprise an axial body, such as that of a drill bit or stabilizer. One or more extendable cutting elements may be extendable in a single radial direction from an exterior of the body as the body rotates within a borehole. Extension of the cutting elements may allow them to engage and degrade an inner wall of the borehole. By timing these extensions various cross-sectional shapes may be created.

An abrasion-resistant gauge pad, protruding from the exterior of the body, may ride against the borehole wall without rapidly wearing the gauge pad or significantly damaging the borehole. Riding against the borehole wall provided with the cross-sectional shape described earlier may urge the body radially.

DRAWINGS

FIG. 4-1 is a perspective view of an embodiment of a piston comprising a plate of superhard material. FIG. 4-2 is a perspective view of an embodiment of a piston comprising a plurality of cutting elements.

FIGS. 5-1 and 5-3 are perspective views of embodiments of drill bits comprising cutting elements extendable via rotation of a hinged arm. FIG. 5-2 is a perspective view of an embodiment of a hinged arm.

FIGS. 6-1 and 6-3 are perspective views of embodiments of drill bits comprising cutting elements extendable via rotation of a cylindrical drum. FIG. 6-2 is a perspective view of an embodiment of a cylindrical drum.

FIGS. 8-1 through 8-3 are perspective views of embodiments of gauge pads.

FIGS. 8-4 and 8-5 are perspective views of embodiments of abrasion-resistant devices.

DETAILED DESCRIPTION

Figure 1:
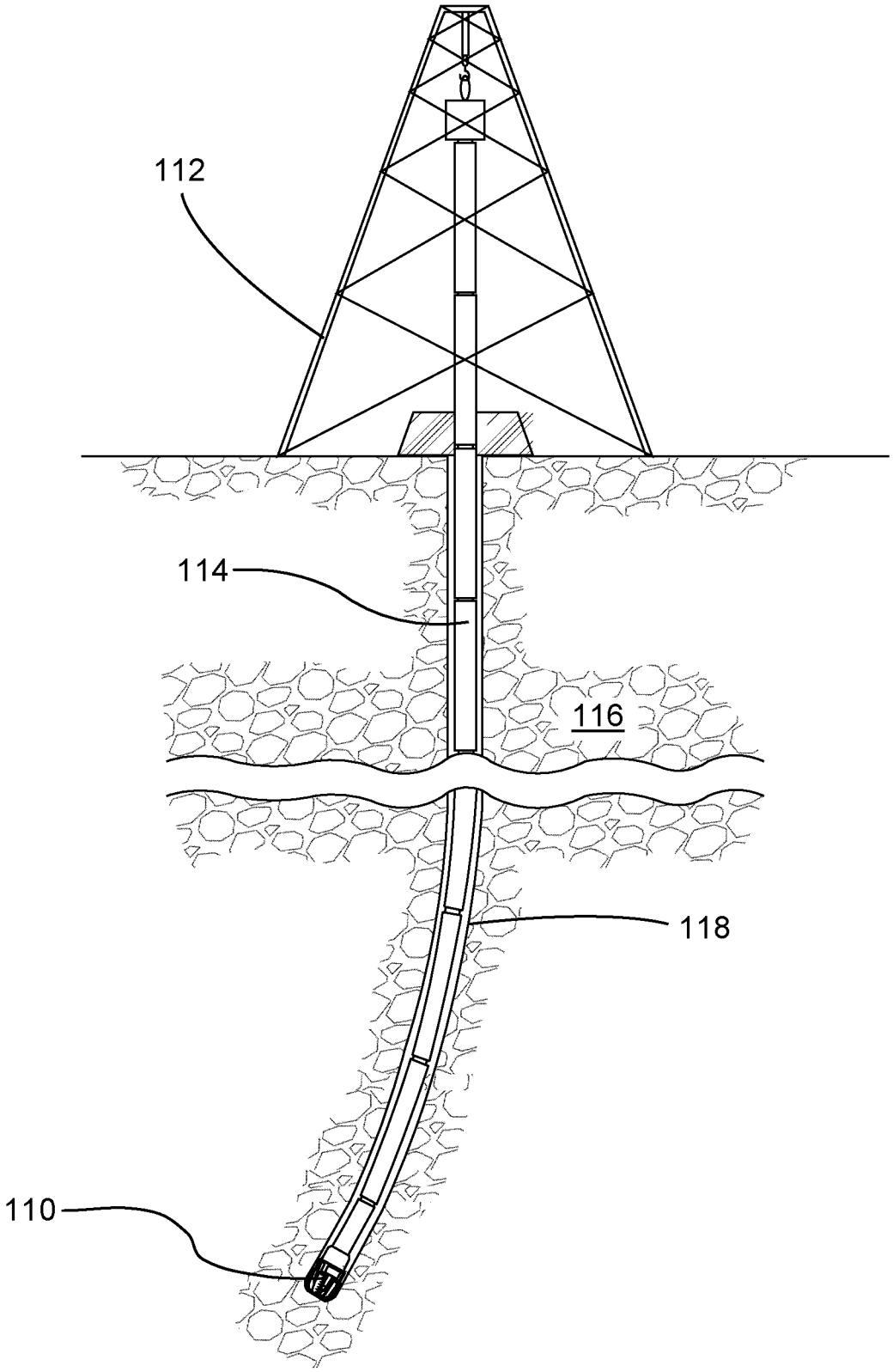
FIG. 1 is an orthogonal view of an embodiment of a subterranean drilling operation.

Referring now to the figures, FIG. 1 shows an embodiment of a subterranean drilling operation of the type commonly used to form boreholes in the earth. As part of this drilling operation, a drill bit 110 may be suspended from a derrick 112 by a drill string 114. While a land-based derrick 112 is depicted, comparable water-based structures are also common. Such a drill string 114 may be formed from a plurality of drill pipe sections fastened together end-to-end, as shown, or, alternately, a flexible tubing. As the drill bit 110 is rotated, either with torque from the derrick 112 passed through the drill string 114 or by a downhole motor, it may engage and degrade a subterranean formation 116 to form a borehole 118 therethrough. Boreholes formed in this manner typically comprise a generally cylindrical shape.

Figure 2:
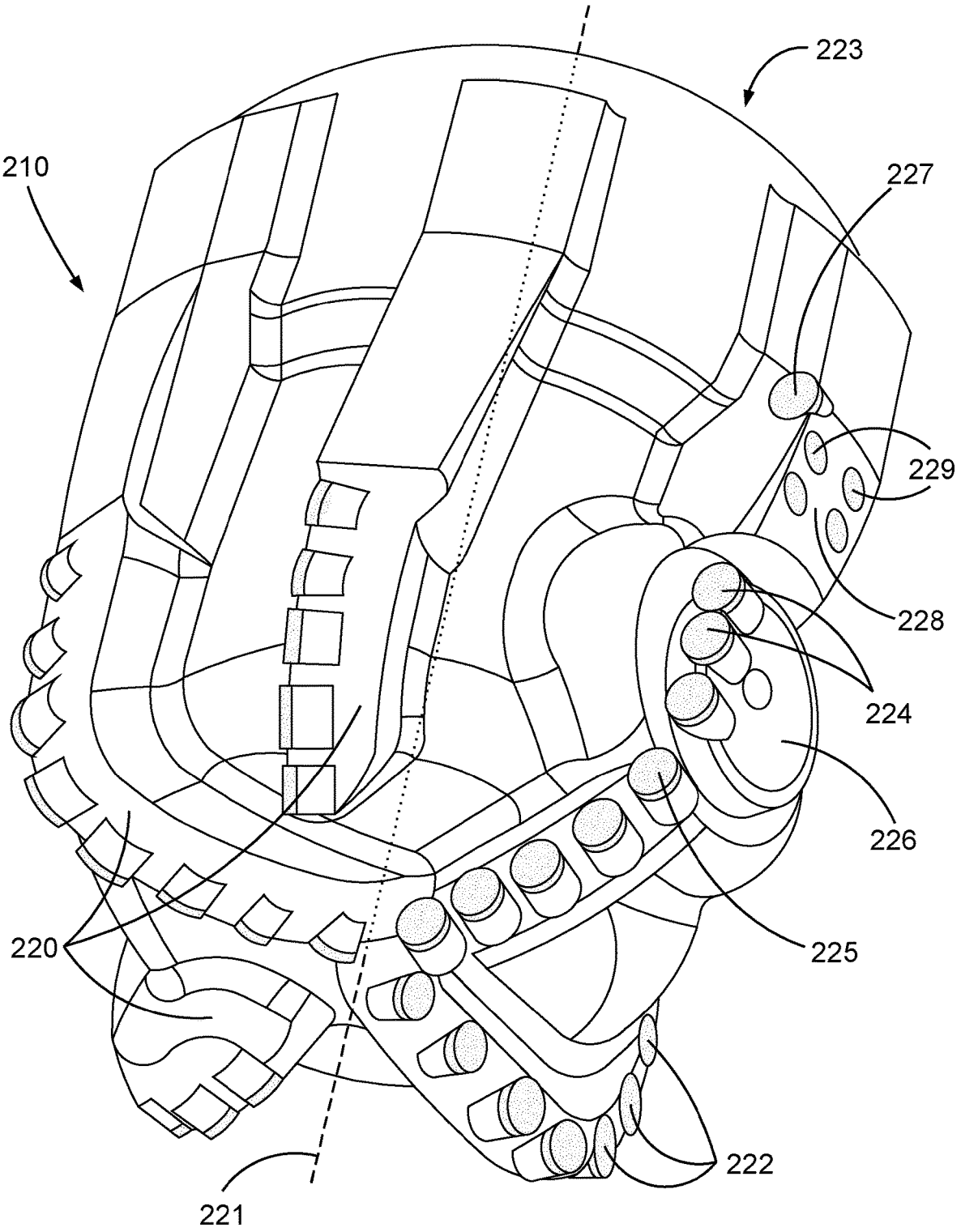
FIG. 2 is a perspective view of an embodiment of a drill bit that may form part of a subterranean drilling operation.

FIG. 2 shows an embodiment of a drill bit 210 that may form part of a subterranean drilling operation as just described. Although any of a variety of drill bit types may be functional with the novel elements described herein (e.g. roller cone bits, diamond impregnated bits and hybrids thereof), the embodiment of the drill bit 210 shown comprises a plurality of blades 220 protruding from one end thereof spaced around a rotational axis 221 thereof. In the embodiment shown the plurality of blades 220 are generally aligned with the rotational axis 221, however in other embodiments blades may spiral around a circumference of a drill bit. A plurality of cutting elements 222, capable of degrading tough earthen matter, may be disposed on each of the blades 220. If this drill bit 210 is rotated within an earthen formation, these cutting elements 222 would normally create a generally cylindrically shaped borehole with a constant radius. The drill bit 210 may also comprise a threadable attachment 223, comprising a series of threads disposed within a cavity (hidden), disposed on an opposite end from the plurality of blades 220.

Additional cutting elements 224 may be extendable in a generally radial direction from an exterior of the drill bit 210. Extension of these cutting elements 224 may cause them to engage a wall of a borehole (not shown) through which the drill bit 210 may be traveling and scrape earthen material away from the borehole wall at certain points around its circumference. This scraping may cause the shape of the borehole to deviate away from the generally cylindrical shape initially created by the rigidly-secured cutting elements 222 of the drill bit 210. For example, if the cutting elements 224 are extended during only a portion of a full rotation of the drill bit 210, then the borehole may be given a new cross-sectional shape comprising two distinct radii, an initial radius formed by the secured cutting elements 222 and an enlarged radius formed by the extendable cutting elements 224.

While any of a variety of cutting element types may be used for extension, the present embodiment depicts a rotatable type of cutting element similar in some respects to those shown in U.S. Pat. No. 7,703,559 to Shen et al.

In the embodiment shown, these extendable cutting elements 224 are secured to an exposed end of a piston 226 that may be extended or retracted by hydraulic pressure. While only a single piston is shown in the present embodiment, in various other embodiments a plurality of extendable cutting elements, each secured to its own unique piston, similar in some respects to those shown in FIG. 2A of U.S. Pat. No. 8,763,726 to Johnson et al., is also possible.

An abrasion-resistant gauge pad 228 may protrude from the exterior of the drill bit 210 and be positioned axially adjacent the extendable cutting elements 224. In the embodiment shown only one abrasion-resistant gauge pad 228 is shown aligned with the single radial direction, however in other embodiments a plurality of abrasion-resistant gauge pads may be positioned at a variety of locations about a circumference of a body. For example, in some embodiments each of a plurality of blades may comprise its own gauge pad. At this gauge pad 228 the drill bit 210 may comprise a cross-sectional radius sized between the two borehole radii discussed previously; larger than the smaller radius formed by the rigid cutting elements 222 but smaller than the larger radius formed by the extendable cutting elements 224. In fact, this gauge pad 228 radius may not fit through a borehole formed exclusively by the rigid cutting elements 222 without the enlargement created by the extendable cutting elements 224. This sizing mismatch may constantly, and with little energy exerted by the drill bit 210, urge the drill bit 210 laterally as the smaller radius pushes the drill bit 210 into space created by the larger radius.

To achieve its abrasion resistance, preventing wear caused by rubbing against the borehole wall, the gauge pad 228 may comprise one or more studs 229 embedded therein. These studs 229 may be formed of superhard materials (i.e. materials comprising a Vickers hardness test number exceeding 40 gigapascals). Generally cylindrical studs are shown in the present embodiment, however studs of a variety of shapes and sizes, and arranged in a variety of patterns, are also contemplated.

Axially adjacent the extendable cutting elements 224 and gauge pad 228 a second cutting element 225 and third cutting element 227 may be rigidly secured to the exterior of the drill bit 210. The second cutting element 225 may sit axially adjacent the extendable cutting elements 224 opposite from the gauge pad 228 while the third cutting element 227 may sit axially adjacent the gauge pad 228 opposite from the extendable cutting elements 224. In the embodiment shown, these second and third cutting elements 225, 227 are shown aligned with the single radial direction, however in other embodiments similar cutting elements may be positioned at a variety of locations about a circumference of a body. The third cutting element 227 may effectively ream out the borehole deviation created by the extendable cutting elements 224, or to a larger diameter, leaving the borehole generally cylindrical once again. While the present embodiment shows a solitary third cutting element 227, in other embodiments a plurality of cutting elements may perform such a reaming function.

Figure 3:
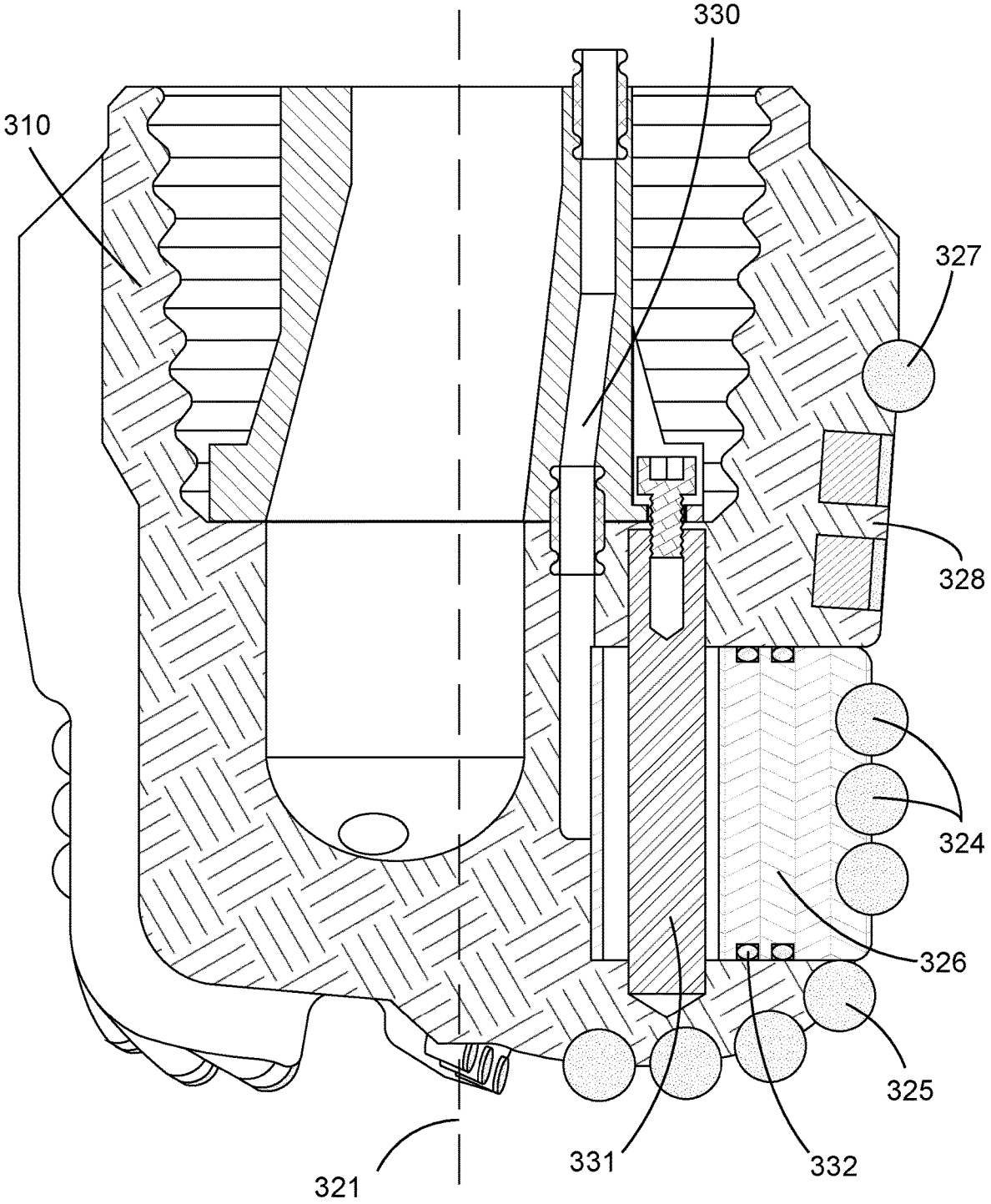
FIG. 3 is a longitude-sectional view of another embodiment of a drill bit.

FIG. 3 shows another embodiment of a drill bit 310 comprising extendable cutting elements 324, an abrasion-resistant gauge pad 328, and second and third cutting elements 325, 327. The gauge pad 328 is seen to slant away from a rotational axis 321 of the drill bit 310. It is believed that this slanting of the gauge pad 328 may aid in allowing a borehole wall to urge the drill bit 310 sideways while avoiding rapid wear due to rubbing. As is also visible from this angle, while a distance from the rotational axis 321 to the extendable cutting elements 324 is variable, similar distances to the gauge pad 328 and second and third cutting elements 325, 327 may be fixed. In this fixed arrangement, the gauge pad 328 may protrude farther from the rotational axis 321 of the drill bit 310 than the second cutting element 325 and the third cutting element 327 may protrude farther than the gauge pad 328.

The extendable cutting elements 324 may be extended or retracted based on hydraulic pressure acting on a base of a piston 326 secured to the cutting elements 324. Pressurized hydraulic fluid may be channeled against the base of the piston 326 via a conduit 330 passing through the drill bit 310 built for this purpose. In various configurations, this hydraulic fluid may be regulated to control a physical position of the piston 326 or a force applied to the piston 326. In the embodiment shown, a pin 331 may be secured to the drill bit 310 and pass through a passageway intersecting the piston 326 similar in some respects to those shown in U.S. Pat. No. 9,085,941 to Hall et al. This pin 331 may regulate the limits of extension and retraction of the cutting elements 324.

A seal 332 may surround a perimeter of the piston 326 to block the pressurized hydraulic fluid from escaping out between the piston 326 and drill bit 310 and into the borehole. In the embodiment shown, this seal 332 takes the form of two elastomeric rings disposed within grooves encircling the piston 326 at around a midpoint of its axial length. In other embodiments, however, a similar seal may be positioned at any point axially along a piston from an exposed portion to a base thereof. Additionally, other seal embodiments may comprise a flexible material like a thin metallic bellows that may, in some circumstances, provide more wear resistance than an elastomer. In some embodiments a close fit may suffice to retain fluid without such a seal.

Figures 1, 4:
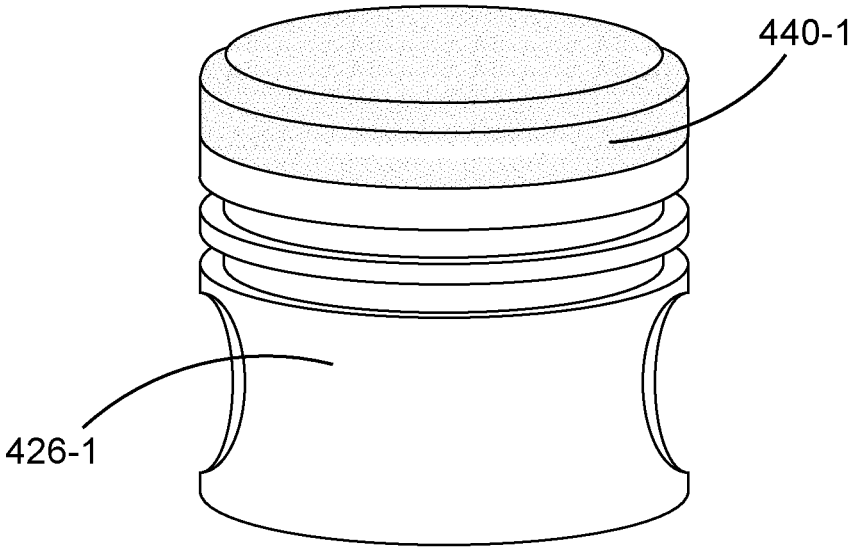
Figures 2, 4:
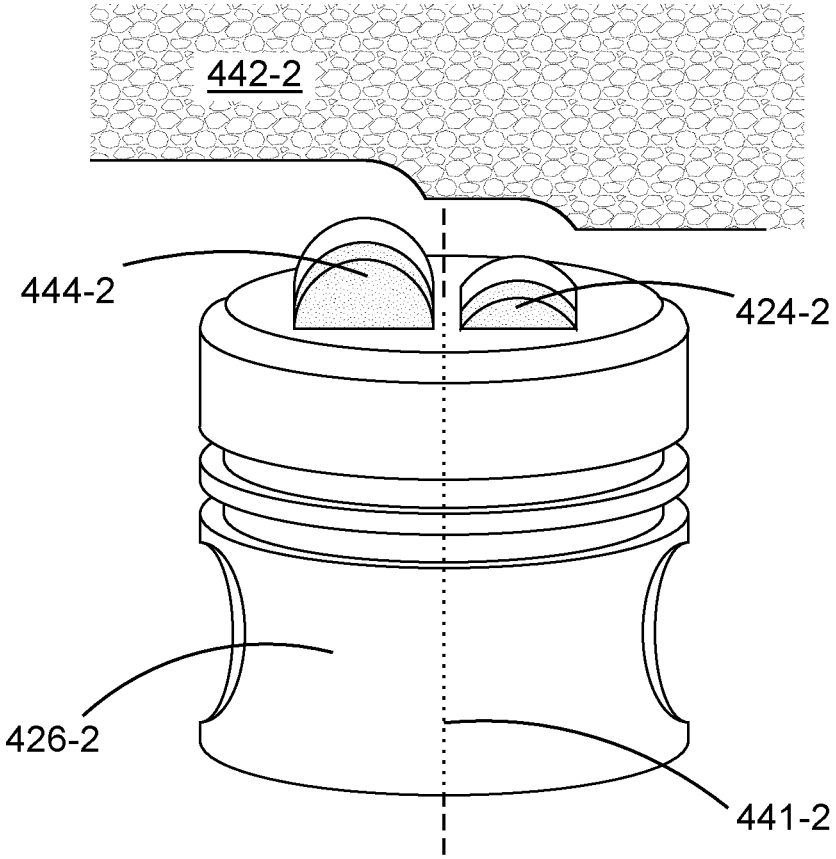

FIG. 4-1 shows an embodiment of a piston 426-1 that may be radially extendable from a drill bit (not shown) or other axial body. Rather than comprising separate cutting elements secured thereto, as shown in embodiments of pistons discussed previously, an entire exposed portion 440-1 of the piston 426-1 may be covered by a plate of superhard material to form a single extendable cutting element. The piston 426-1 may be free to rotate about a central axis thereof to distribute wear about a circumference of the exposed portion 440-1. In the embodiment shown, the exposed portion 440-1 of the piston 426-1 comprises a generally flat principal surface. Alternate embodiments, however, may have any of a variety of non-flat profiles.

FIG. 4-2 shows another embodiment of a piston 426-2 comprising two cutting elements secured to an exposed end thereof. A first cutting element 424-2 secured to the piston 426-2 may protrude from the exposed end a first distance and may dig into a borehole wall 442-2 a certain amount. A second cutting element 444-2 may protrude farther than the first cutting element 424-2 but dig into the borehole wall 442-2 substantially the same amount as the first cutting element 424-2. This is possible if the second cutting element 444-2 is spaced farther from a distal end of an axial body (not shown) than the first cutting element 424-2 and the first cutting element 424-2 removes matter from the borehole wall 442-2 as it digs. In this configuration, reaction forces experienced by the first and second cutting elements 424-2, 444-2 may balance rotational torque around an axis of the piston 441-2.

Figures 1, 5:
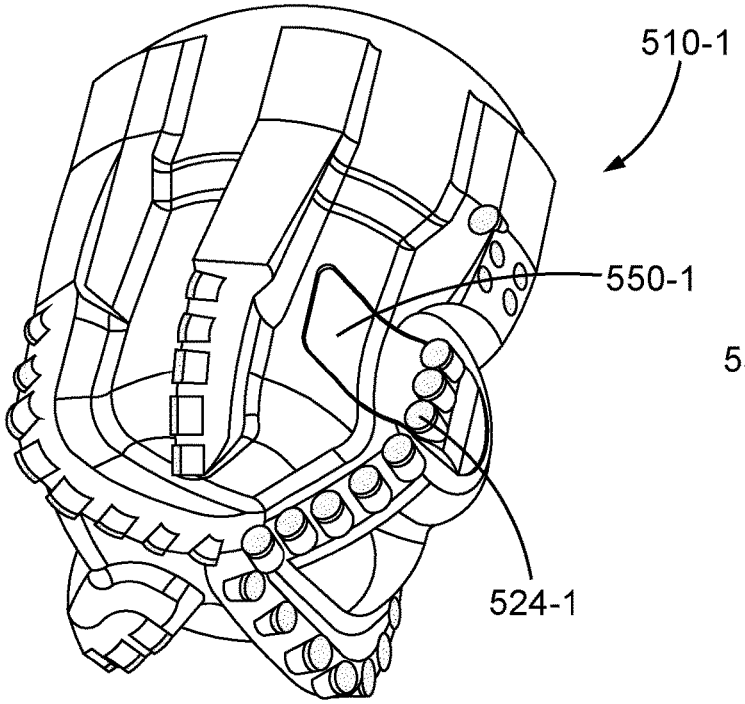
Figures 2, 5:
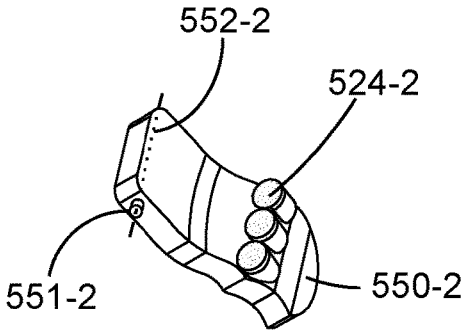
Figures 3, 5:
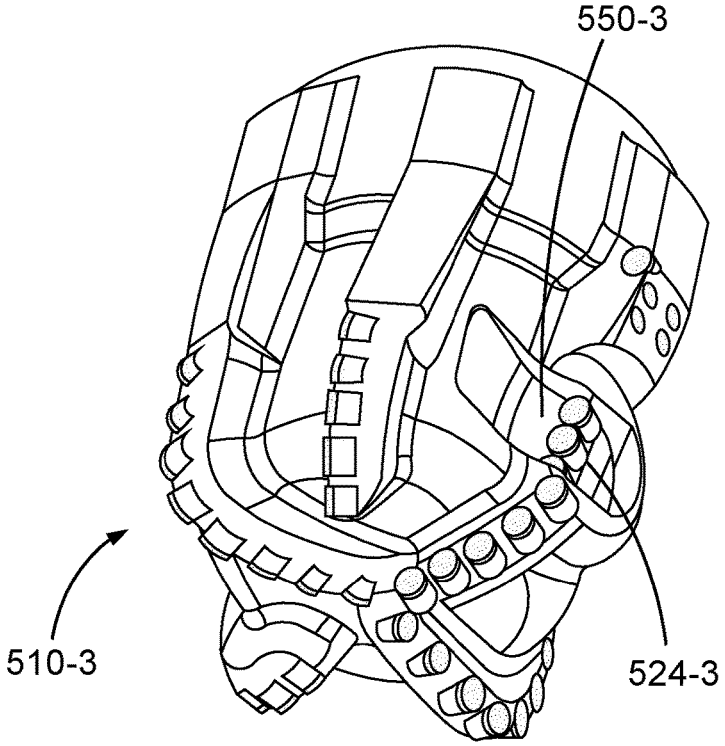

FIG. 5-1 shows an embodiment of a drill bit 510-1 comprising one or more cutting elements 524-1 radially extendable and retractable from an exterior thereof. In the embodiment shown, the cutting elements 524-1 are in an extended configuration exposing them to external impact. These cutting elements 524-1 may be secured to a hinged arm 550-1. FIG. 5-2 shows an embodiment of such a hinged arm 550-2 comprising several cutting elements 524-2 attached thereto and a pin 551-2 extending from a body thereof. The pin 551-2 may attach the hinged arm 550-2 to a drill bit (not shown) such that the hinged arm 550-2 is rotatable about a rotational axis 552-2 passing through the pin 551-2.

FIG. 5-3 shows another embodiment of a drill bit 510-3 comprising a hinged arm 550-3 with cutting elements 524-3 secured thereto. In this embodiment, the hinged arm 550-3 is rotated to retract the cutting elements 524-3 from an exterior of the drill bit 510-3. In this retracted configuration the cutting elements 524-3 may be shielded from impact. Thus, when extended, as shown in FIG. 5-1, the cutting elements 524-1 may engage a borehole wall (not shown) surrounding the drill bit 510-1. Alternatively, while retracted, as shown in FIG. 5-3, the cutting elements 524-3 may be shielded from engaging the borehole wall.

In these embodiments, the rotational axis, about which a hinged arm may rotate, runs generally parallel to a rotational axis of a drill bit. However, other configurations similar in some respects to those shown in U.S. Pat. No. 8,141,657 to Hutton are also possible.

Figures 1, 6:
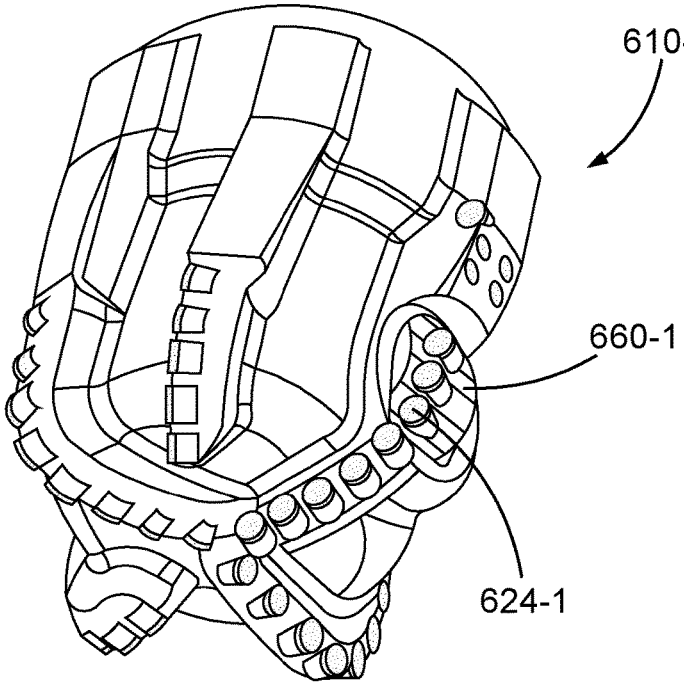
Figures 2, 6:
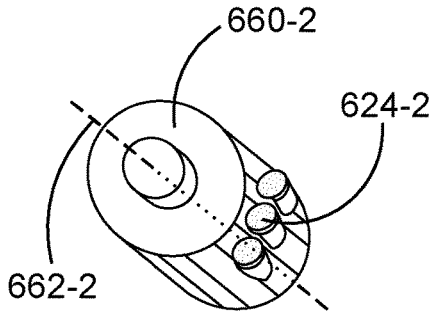
Figures 3, 6:
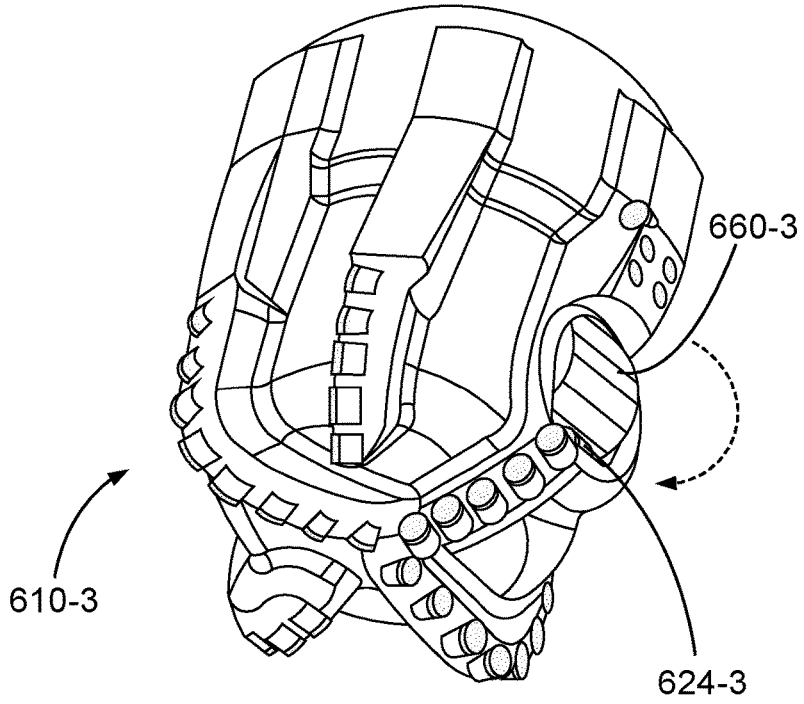

FIGS. 6-1 and 6-3 show additional embodiments of drill bits 610-1 and 610-3 each comprising one or more cutting elements 624-1 and 624-3 radially extendable and retractable from exteriors thereof. These cutting elements 624-1 and 624-3 may be secured to rotatable cylindrical drums 660-1 and 660-3. FIG. 6-2 shows an embodiment of such a cylindrical drum 660-2 comprising cutting elements 624-2 secured thereto and rotatable about a rotational axis 662-2. When rotated to an extended configuration, as shown in FIG. 6-1, the cutting elements 624-1 may engage a borehole wall (not shown) surrounding the drill bit 610-1. While rotated to a retracted configuration, as shown in FIG. 6-3, the cutting elements 624-3 may be shielded from engaging the borehole wall. In these embodiments, the rotational axis, about which the cylindrical drum may rotate, runs generally parallel to a tangent of the drill bit to which the cylindrical drum is attached.

Figure 7:
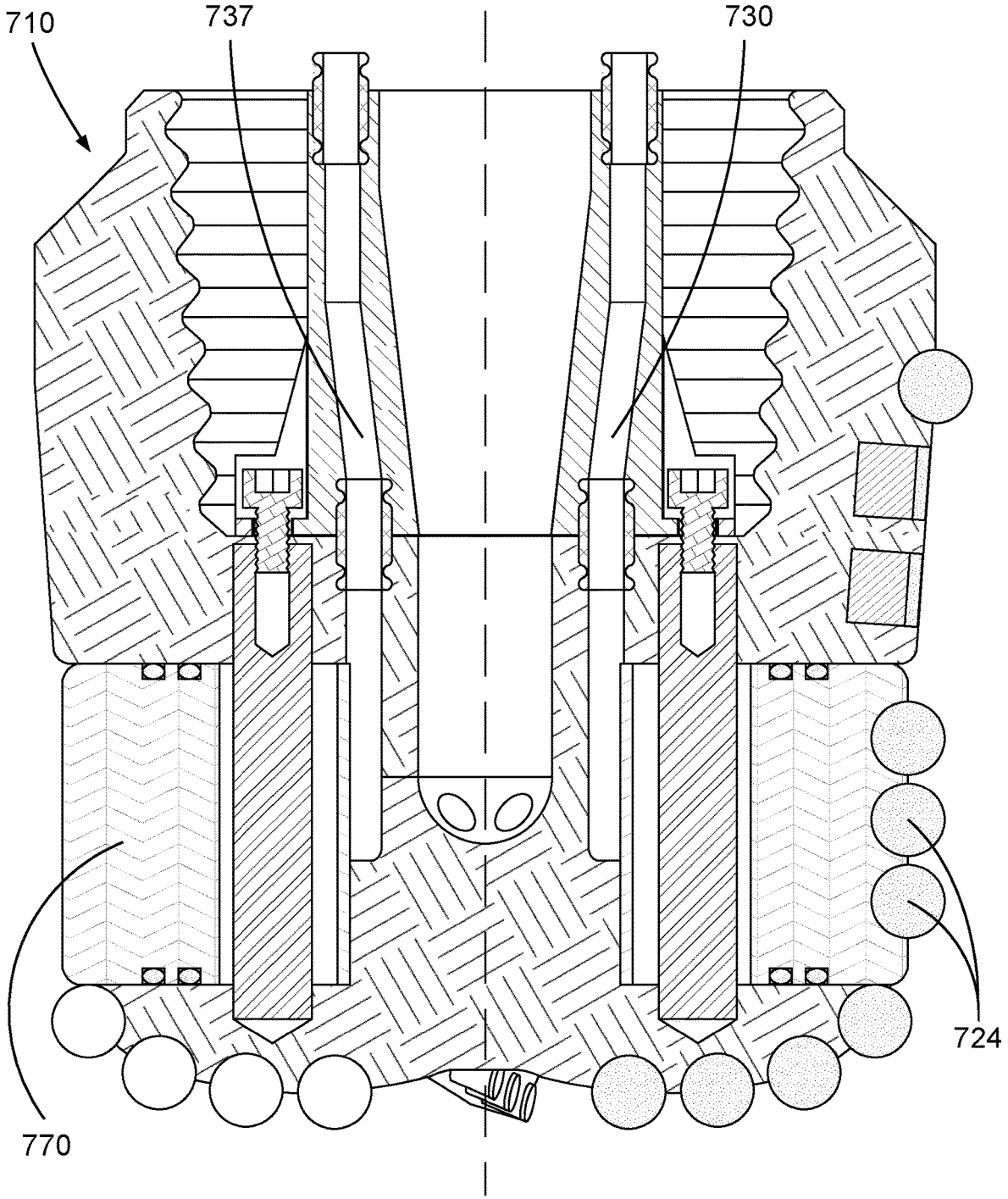
FIG. 7 is a longitude-sectional view of an embodiment of a drill bit comprising an extendable push pad positioned opposite from extendable cutting elements.

FIG. 7 shows another embodiment of a drill bit 710. In addition to cutting elements 724 extendable in a single radial direction (similar in many respects to embodiments previously described), the drill bit 710 of the present embodiment further comprises a push pad 770 extendable from the exterior opposite from the single radial direction. Such a push pad 770 may push off a borehole wall (not shown) surrounding the drill bit 710 to push the drill bit 710 toward the cutting elements 724. This pushing may stabilize the drill bit 710 as the cutting elements 724 engage the borehole wall. This pushing may also urge the drill bit 710 into the now degraded borehole wall to aid in directing the drill bit 710 as it progresses.

In the embodiment shown, both the push pad 770 and the cutting elements 724 are connected to sources of pressurized hydraulic fluid that may impel them outward. In some embodiments, this may even be the same source. In such cases, if a conduit 737 channeling pressurized hydraulic fluid to the push pad 770 is activated simultaneously with a conduit 730 channeling pressurized hydraulic fluid to the extendable cutting elements 724 then both may extend at the same time.

To avoid damaging a borehole wall, and disturbing its cross-sectional shape, various elements may be added to the gauge pads previously described. For example, the gauge pad 228 shown in FIG. 2 comprises a plurality of studs 229 formed of superhard materials embedded therein. These studs 229 may allow the gauge pad 228 to smoothly push off a borehole wall. In other embodiments, such as one shown in FIG. 8-1, a gauge pad 828-1 may comprise a plate 829-1 of superhard material secured thereto and covering an exposed section thereof. It is believed that such a plate may enhance the smooth borehole push off.

Figures 1, 8:
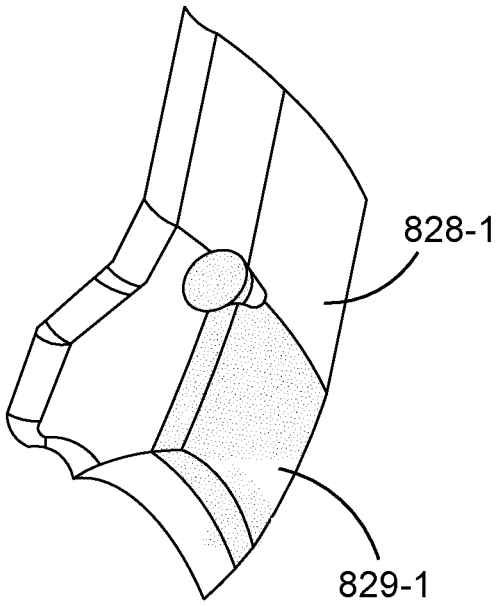
Figures 2, 8:
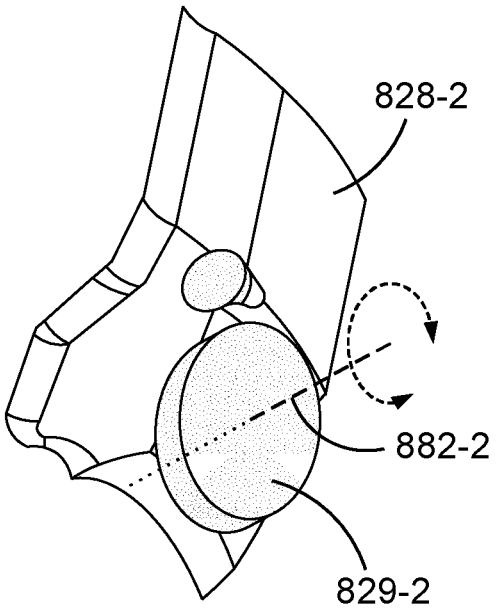
Figures 3, 8:
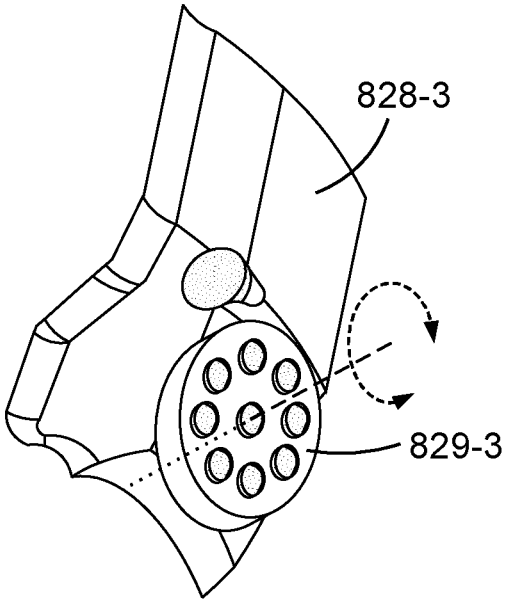
Figures 4, 8:
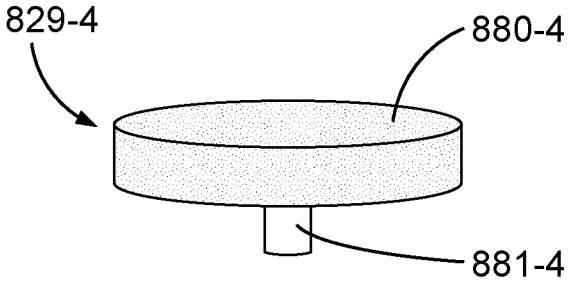
Figures 5, 8:
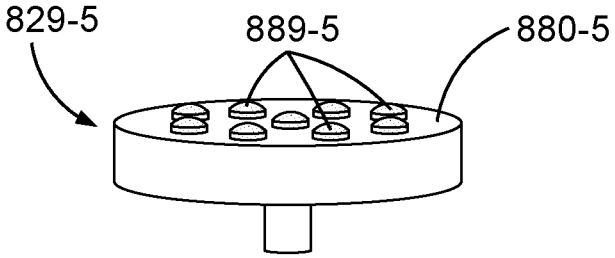

In an embodiment shown in FIG. 8-2, an abrasion-resistant device 829-2 may be attached to a gauge pad 828-2 such that it may freely rotate about an axis 882-2. When acted upon by an external force, such as from a borehole wall, this abrasion-resistant device 829-2 may rotate out of the way rather than resist. It is believed that this lack of resistance may protect both the borehole wall and the gauge pad 828-2. FIG. 8-4 shows an embodiment of an abrasion-resistant device 829-4, similar to that shown in FIG. 8-2, comprising a plate 880-4 of superhard material secured to a shaft 881-4. This shaft 881-4 may be attached to a gauge pad allowing the plate 880-4 to rotate thereabout.

FIG. 8-3 shows another embodiment of an abrasion-resistant device 829-3 rotatably attached to a gauge pad 828-3 and FIG. 8-5 shows an embodiment of a similar abrasion-resistant device 829-5. Rather than comprising a plate of superhard material, the abrasion-resistant device 829-5 may comprise a plate 880-5 formed of hard material with a plurality of studs 889-5, formed of superhard material, embedded therein. While FIGS. 8-2 and 8-3 show embodiments of abrasion-resistant devices 829-2, 829-3 connected to gauge pads 828-2, 828-3 at only one end of a rotatable axis projecting generally outward from the gauge pad 828-2, 828-3, other embodiments of abrasion-resistant devices may comprise rotational axes in various alternate orientations and possibly connected to a gauge pad at multiple ends.

Figure 9:
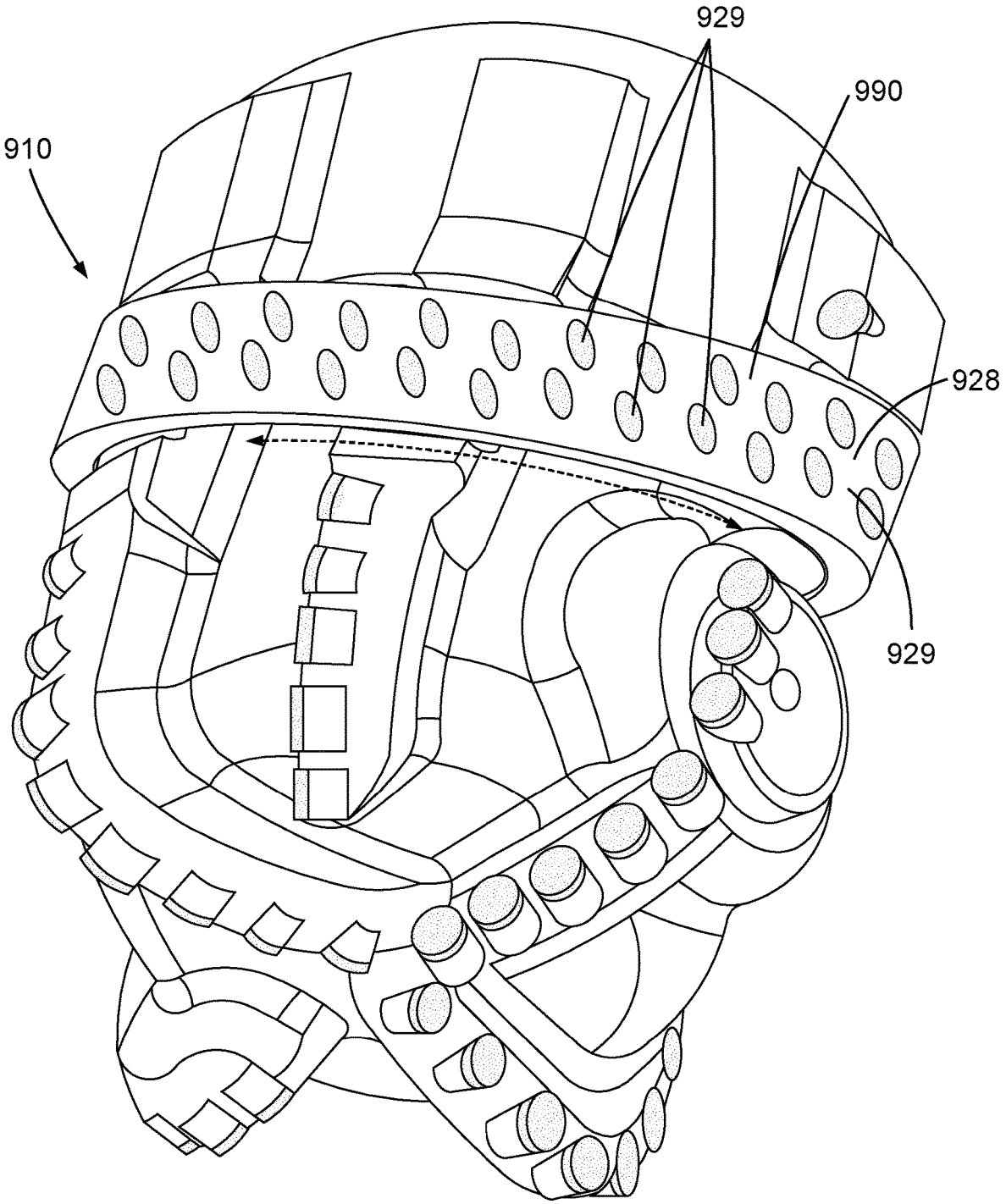
FIG. 9 is a perspective view of another embodiment of a drill bit.

FIG. 9 shows an embodiment of a drill bit 910 comprising a unique gauge pad 928. This gauge pad 928 comprises an abrasion-resistant device 929 formed generally in the shape of a ring 990 with a plurality of studs 929, formed of superhard materials, embedded in an exterior surface thereof. In the embodiment shown, this ring 990 generally surrounds a circumference of the drill bit 910. However, other sizes and configurations are also possible. When acted upon by an external force the ring 990 may rotate around an axis thereof rather than resist.

Figure 10:
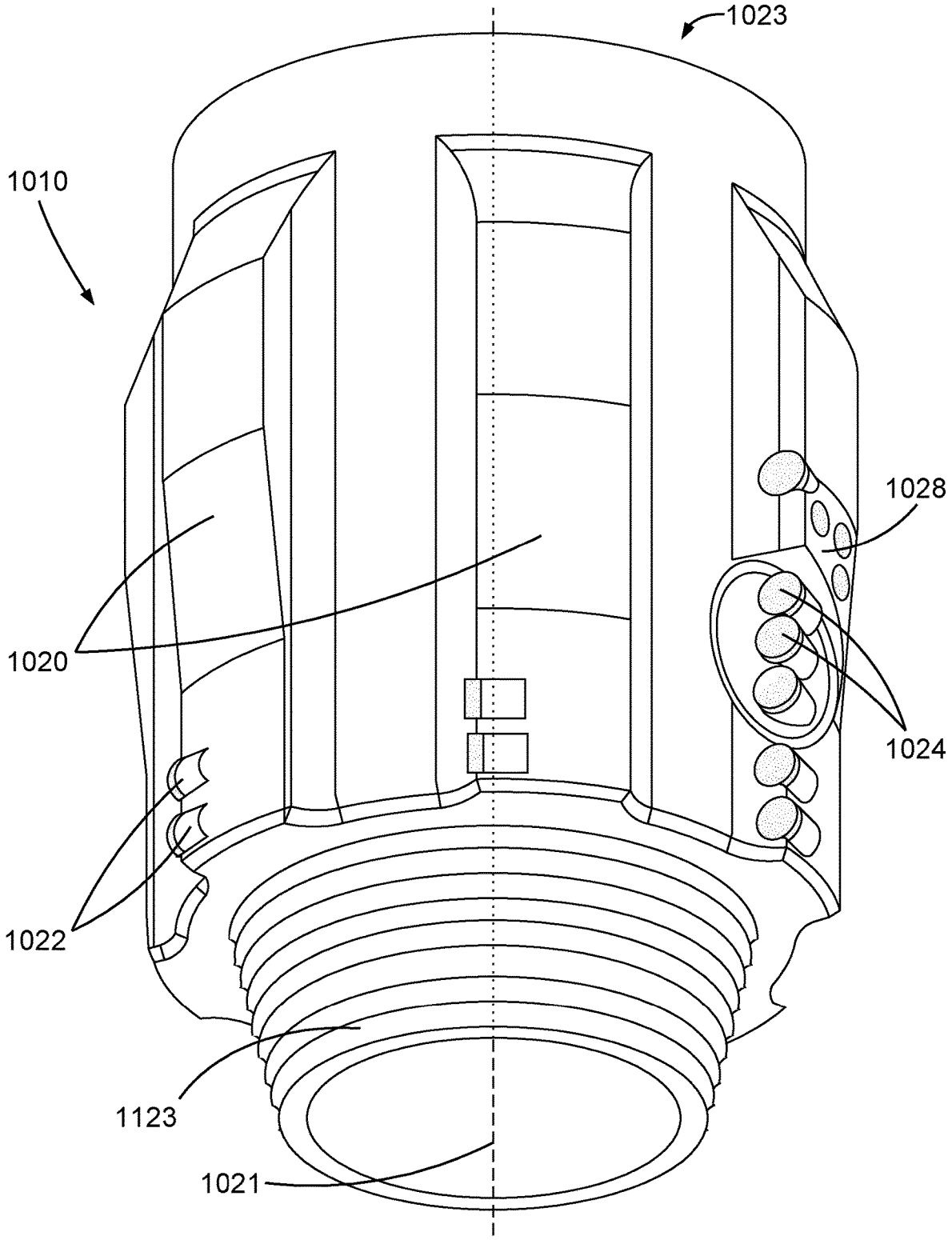
FIG. 10 is a perspective view of an embodiment of a stabilizer.

FIG. 10 shows an embodiment of a stabilizer 1010 that may form part of a subterranean drilling operation. The stabilizer 1010 may comprise a plurality of blades 1020 protruding therefrom spaced around a rotational axis 1021 thereof. A plurality of cutting elements 1022, capable of degrading tough earthen matter, may be disposed on each of the blades 1020. The stabilizer 1010 also comprises threadable attachments 1023, 1123 disposed on opposite ends thereof. Additional cutting elements 1024 may be extendable in a single radial direction from an exterior of the stabilizer 1010. Extension of these cutting elements 1024 may cause them to engage a wall of a borehole (not shown) through which the stabilizer 1010 is traveling. This engagement may degrade the borehole wall at certain points around its circumference causing a cross-sectional shape of the borehole to deviate away from circular. Additionally, an abrasion-resistant gauge pad 1028 may protrude from the exterior of the stabilizer 1010 and be positioned axially adjacent the extendable cutting elements 1024.

Whereas this discussion has revolved around the drawings attached hereto, it should be understood that other and further modifications apart from those shown or suggested herein, may be made within the scope and spirit of the present disclosure.

The invention claimed is:

1. A downhole drilling assembly, comprising: an axial body; one or more extendable cutting elements all extendable from an exterior of the body in a single radial direction; and an abrasion-resistant gauge pad protruding from the exterior of the body; and a rigid cutting element secured to the exterior, axially adjacent the one or more extendable cutting elements and opposite from the gauge pad; wherein the gauge pad protrudes a fixed distance farther from the body than the rigid cutting element; and the one or more extendable cutting elements extend a variable distance farther from the body than the gauge pad.

2. The downhole drilling assembly of claim 1, wherein the one or more extendable cutting elements are extendable via hydraulic pressure on one or more pistons.

3. The downhole drilling assembly of claim 2, wherein the one or more pistons comprise a superhard material covering exposed portions thereof.

4. The downhole drilling assembly of claim 2, wherein two extendable cutting elements are exposed on a single piston, one extendable cutting element protruding farther from the axial body than the other extendable cutting element.

5. The downhole drilling assembly of claim 4, wherein the extendable cutting element protruding farther from the axial body is disposed at a greater distance from a distal end of the axial body than the other extendable cutting element.

6. The downhole drilling assembly of claim 2, further comprising an elastomeric or flexible seal surrounding one or more of the pistons.

7. The downhole drilling assembly of claim 1, wherein the one or more extendable cutting elements are extendable via rotation of a rotor.

8. The downhole drilling assembly of claim 1, further comprising one or more push pads extendable from the exterior opposite from the single radial direction.

9. The downhole drilling assembly of claim 8, wherein both the one or more extendable cutting elements and one or more push pads are extendable via the same hydraulic pressure.

10. The downhole drilling assembly of claim 1, wherein the gauge pad is axially slanted.

11. The downhole drilling assembly of claim 1, wherein the gauge pad comprises a superhard plate disposed therein.

12. The downhole drilling assembly of claim 1, wherein the gauge pad comprises one or more rotatable abrasion-resistant elements secured thereto.

13. The downhole drilling assembly of claim 12, wherein the one or more rotatable abrasion-resistant elements each comprise a plate of superhard material or a plate of hard material with a plurality of superhard studs disposed therein.

14. The downhole drilling assembly of claim 1, wherein the gauge pad comprises a rotatable ring surrounding the body.

15. The downhole drilling assembly of claim 1, further comprising another rigid third cutting element rigidly secured to the exterior, axially adjacent the gauge pad and opposite from the one or more extendable cutting elements.

16. The downhole drilling assembly of claim 15, wherein the other rigid cutting element protrudes farther from the body than the gauge pad.

17. The downhole drilling assembly of claim 1, wherein the body forms a drill bit comprising a plurality of cutting elements disposed on one end thereof and a threaded attachment disposed on an opposite end thereof.

18. The downhole drilling assembly of claim 1, wherein the body forms a stabilizer comprising threaded attachments disposed on opposite ends thereof.

* * * * *